United States Patent [19]

Miszak

[11] 4,325,328

[45] Apr. 20, 1982

[54] VAPOR GENERATOR HAVING A PAIR OF COMBUSTION CHAMBERS

[75] Inventor: Pawel Miszak, Winterthur, Switzerland

[73] Assignee: Sulzer Brothers Limited, Winterthur, Switzerland

[21] Appl. No.: 175,881

[22] Filed: Aug. 6, 1980

[30] Foreign Application Priority Data

Aug. 22, 1979 [CH] Switzerland ..... 7649/79

[51] Int. Cl.[3] ..... F22B 37/00

[52] U.S. Cl. ..... 122/6 A; 122/235 A; 122/479 S; 122/488

[58] Field of Search ..... 122/460, 2, 488, 6 A, 122/479 S, 451 S, 451 R, 235 A

[56] References Cited

U.S. PATENT DOCUMENTS

| | | | |
|---|---|---|---|
| 2,741,228 | 4/1956 | Vorkauf | 122/488 |
| 2,887,095 | 5/1959 | Vorkauf | 122/488 |
| 3,135,244 | 6/1964 | Caracristi | 122/479 S |
| 3,769,942 | 11/1973 | Brehler | 122/487 |
| 3,814,062 | 6/1974 | Vollhardt | 122/6 A |
| 4,194,468 | 3/1980 | Augusburger | 122/451 R |

*Primary Examiner*—Henry C. Yuen

*Attorney, Agent, or Firm*—Kenyon & Kenyon

[57] ABSTRACT

The vapor generator is provided with a vapor separator which is connected to an outlet of the partition and which has a water outlet connected to the inlet of the enclosing walls of the combustion chambers. The vapor outlet of the vapor separator connects to a superheater within the generator via platen superheaters disposed within their respective combustion chambers. The vapor separator permits the partition to always be operated with a considerable surplus of water so that no stability problems occur. A water separator is also connected to an outlet of the enclosing walls and has a vapor outlet connected with the vapor outlet from the vapor separator. Various control circuits can be used to regulate the flow of vapor from the vapor separator to the superheater. A branch conduit for the feed water is also connected in parallel with the partition to permit mixing of some of the feed water with the water separated out of the vapor separator prior to passage into the enclosing walls of the generator.

7 Claims, 3 Drawing Figures

VAPOR GENERATOR HAVING A PAIR OF COMBUSTION CHAMBERS

Figure 1:
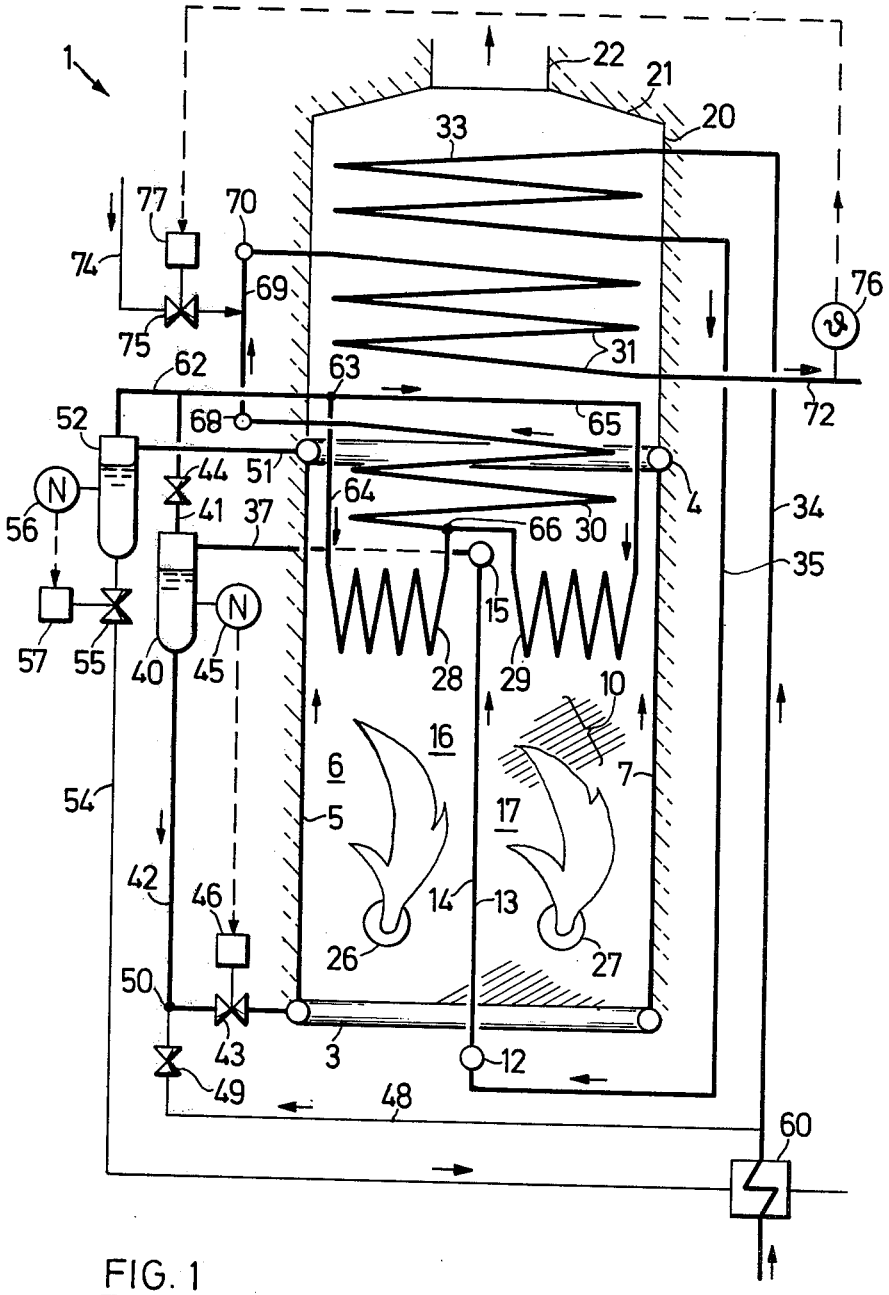

This invention relates to a vapor generator. More particularly, this invention relates to a vapor generator having a pair of combustion chambers disposed on opposite sides of a partition.

Heretofore, it has been known to construct a vapor generator from four enclosing walls and one partition between the walls so as to define two separate combustion chambers. In such cases, the enclosing walls and the partition are formed from interconnected tubes which carry a working medium. In addition, the partition and walls are arranged so that the working medium flows in series first through the partition and then through the enclosing walls. Vapor generators of this type have been used for operation at super critical pressure and have proved satisfactory in practice. However, if such a vapor generator is operated with a sliding pressure in order to save energy, difficulties may arise in the sub-critical pressure states of operation because any vapor which is formed in the partition is unevenly distributed over the tubes of the enclosing walls.

Although techniques are known for improving the uniformity of distribution of a mixture of water and vapor over parallel tubes, the distribution of the vapor must be very accurate when the tubes are welded in sealed-tight relationship to form enclosing walls. This is because any lack of uniformity may result in different mass flows in adjacent tubes and, hence, considerable temperature differences. These temperature differences may, in turn, give rise to thermal stresses which must be avoided.

It has been known to connect the partition and the enclosing walls of such vapor generators in parallel so that the working medium can be separately fed to the partition and enclosing walls. However, because the partition represents a relatively short heating surface, it has been very difficult to adjust the partition so that the working medium does not superheat in individual tubes.

Accordingly, it is an object of this invention to provide for a uniform temperature in the enclosing walls of the combustion chambers of a multi-combustion chamber vapor generator.

It is another object of the invention to avoid large temperature differences in the enclosing walls of a vapor generator having side-by-side combustion chambers separated by a partition.

Briefly, the invention is directed to a vapor generator which is comprised of a plurality of interconnected tubes which define four enclosing walls and a partition for conveying a working medium therethrough in series from the partition to the enclosing walls. The partition is disposed within the enclosing walls so as to form two combustion chambers. In addition, the vapor generator has a superheater disposed within the enclosing walls to receive the working medium. In accordance with the invention, a vapor separator is connected to an outlet of the partition to receive working medium therefrom. This separator also has a water outlet which is connected to an inlet of the enclosing walls in order to deliver working medium thereto as well as a vapor outlet connected to an inlet of the superheater to deliver vapor thereto. In this construction, the partition is always operated with a considerable surplus of water. Hence, there are no stability problems during operation.

As compared with a parallel circuit, the vapor generator has no need for a second feed control system.

The vapor generator is also provided with a water separator which has an inlet connected to an outlet of the enclosing walls and a vapor outlet connected to the inlet of the superheater in order to deliver vapor thereto. This provides a circuit for the working medium which is very simple from a structural viewpoint.

The vapor generator may also further comprise an economizer for the working medium which is connected to the partition on an upstream side relative to the flow of working medium as well as a circulating pump between the economizer and the partition for pumping the working medium therebetween. In this case, the water separator has a water outlet connected to an inlet of the pump. This construction offers very high security for the uniformity of the temperature distribution in the enclosing walls when the vapor generator is operated under partial load conditions. The construction also enables the total pressure drop to be reduced at full load. This results in a higher boiler efficiency.

The vapor generator may also be provided with a means for controlling the water level in the vapor separator. To this end, the vapor generator includes a connecting line between the water outlet of the vapor separator and the inlet of the walls, a throttle valve in the connecting line for controlling the flow of working medium therethrough and means for controlling the valve in dependence upon the level of water in the vapor separator.

In order to further improve the efficiency of the vapor generator, the pressure drop of the vapor generator can be optimized. To this end, the vapor generator includes a second connecting line between the vapor outlet of the vapor separator and the inlet of the superheater, a throttle valve in the second connecting line for controlling the flow of working medium therethrough and means for controlling the throttle valve in dependence upon the level of water in the vapor separator.

The vapor generator may also have a branch conduit in parallel with the partition relative to the flow of working medium. In this case, the branch conduit is connected to the connecting line between the vapor separator and the walls upstream of the throttle valve in the line relative to the flow of working medium and acts as a by-pass conduit. In this way, the water fed to the enclosing walls can be supercooled via the by-pass conduit. Thus, there is no risk that any vapor bubbles which may arise due to a pressure drop would cause distribution difficulties in the enclosing walls.

A control valve may also be provided in the branch conduit while a temperature measuring element is disposed in the connecting line between the connection point of the branch conduit to the connecting line and the enclosing walls for measuring the temperature of the working medium flowing therethrough. This temperature measuring element is connected to the control valve in order to control the valve in response to the measured temperature. This allows a constant supercooling and, hence, substantially the same security with respect to distribution difficulties.

Figure 2:
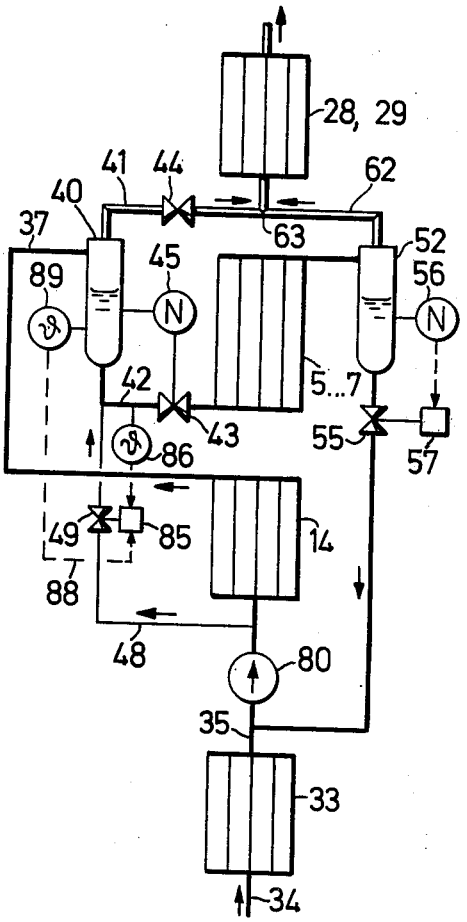

These and other objects and advantages of the invention will become more apparent from the following detailed description taken in conjunction with the accompanying drawings in which:

FIG. 1 diagrammatically illustrates a vertical sectional view through a vapor generator of the tower boiler type in accordance with the invention;

FIG. 2 illustrates a circuit diagram of a modified vapor generator constructed in accordance with the invention; and FIG. 3*a*–3*e* illustrate various control circuits for a vapor generator according to the invention.

Referring to FIG. 1, the vapor generator is constructed of a plurality of interconnected tubes in order to define four enclosing walls 5, 6, 7 (only three of which are shown) and a partition 14 for conveying a working medium therethrough in series from the partition 14 to the walls 5, 6, 7, 8. In addition, the vapor generator has a bottom collector ring 3 and a top collector ring 4 between which the four enclosing walls extend. As indicated, each of the enclosing walls consists of a plurality of inclined parallel wall tubes 10 which are connected to and between the rings 3, 4. The partition 14 is formed of vertical tubes 13 which extend from a header 12 to a collector 15. The partition 14 is disposed within the enclosing walls so as to form two combustion chambers 16, 17. These combustion chambers 16, 17 are closed at the bottom by an end or funnel (not shown). The walls of such an end or funnel may also form part of the tubes of the enclosing walls.

As shown, the enclosing walls 5–8 are continued above the collector ring 4 in the form of an insulated sheet metal casing 20 of rectangular cross section, and, subsequently, into a connection 21 to a chimney 22.

The vapor generator also has a burner 26, 27 extending into each of the combustion chambers 16, 17 respectively.

Two platen heating surfaces 28, 29 are disposed in the top zone of the combustion chambers 16, 17 while a superheater 30 is disposed in the zone above the partition 14 within the enclosing walls. A final superheater 31 is also positioned above the superheater 30 while an economizer 33 is provided at the very top of the vapor generator.

A conduit 34 for a working medium extends to the economizer 33 while an outlet of the economizer 33 is connected via a conduit 35 to the header 12 of the partition 14.

A vapor separator 40 is connected to an outlet of the partition 14, i.e., to the collector 15, via a connecting line or conduit 37 in order to receive working medium therefrom. The vapor separator 40 has a water outlet which is connected via a connecting line 42 having a throttle valve 43 therein to an inlet, i.e., the bottom ring 3, of the enclosing walls in order to deliver water thereto. The throttle valve 43 serves to control the flow of working medium delivered to the collector ring 3. In addition, means are provided for controlling the throttle valve in dependence upon the level of water in the vapor separator 40. This means is in the form of a level transmitter 45 which measures the level of water in the vapor generator 40 and a controller 46 which receives a signal from the transmitter 45 in order to adjust the opening and closing of the throttle valve 43.

As shown, a branch conduit 48 is connected in parallel with the partition 14 relative to the flow of working medium between the feed conduit 34 and the connecting line 42. As shown, the conduit 48 connects to the connecting line 42 at a mixing point 50 upstream of the throttle valve 43 relative to the flow of working medium in the line 42. The branch conduit 48 also has a control valve 49 therein from controlling the flow therethrough.

The vapor separator 40 also has a vapor outlet which is connected via a conduit 41 to a line 62 which leads via a branch point 63 over two branch lines 64, 65 to the platen heating surfaces 28, 29 and thence to an inlet of the superheater 30. The conduit 41 includes an adjusting valve 44 for purposes as explained below.

The vapor generator also has a water separator 52 having an inlet connected via a conduit 51 to an outlet, i.e., the collector ring 4 of the enclosing walls 5–8. This water separator 52 has a water outlet which is connected via a water return conduit 54 containing a control valve 55 to a recuperator 60 in the feed line 34 and, thence, to a feed water tank (not shown). The control valve 55 is influenced by a level transmitter 56 connected to the water separator 52 and a controller 57 which receives a signal from the transmitter 56 in order to regulate the valve 55.

The water separator 52 also has a vapor outlet connected to the line 62 leading to the branch point 63 for delivering vapor to the platen heating surfaces 28, 29 and thence to the superheater 30.

As shown, the superheater 30 has an outlet which is in the form of a collector 68 which connects via a connecting conduit 69 to a collector 70 which forms an inlet for the final superheater 31. The final superheater 31 connects at an outlet to a live vapor conduit 72 which leads to a vapor utilization circuit (not shown).

The vapor generator also has water injection conduit 74 which connects into the connecting conduit 69 and contains an injection valve 75 which is influenced via a controller 77 by a temperature transmitter 76 mounted in the live vapor conduit 72.

During operation, feed water flows via the recuperator 60 and economizer 33 —while still supercooled with respect to the saturated vapor temperature— into the header 12. The water is then distributed uniformly into the vertical tubes 13 of the partition 14. Almost one-quarter of the flow of water is evaporated and the resulting mixture flows into the vapor separator 40. The vapor is then separated and fed to the heating surfaces 28, 29 via the conduit 41 and the adjusting valve 44.

The water which is in a state of saturation flows from the separator 40 to the mixing point 50 and combines with the feed water from the branch conduit 48 while being slightly supercooled. The supercooled water then flows through the throttle valve 43 to the bottom collector ring 3. The water is then distributed uniformly over the tubes 10 which extend through the enclosing walls to the collecting ring 4. About 98% of the water, for example, is evaporated in these walls given a 50% load. The mixture is then separated in the water separator 52. Water then flows from the water separator 52 through a conduit 54 and the recuperator 60 to the feed tank (not shown). During flow through the recuperator 60, the water yields a considerable proportion of its sensible heat. The vapor in the water separator 52 flows into the line 62 and combines with the vapor from the vapor separator 40 to flow to the platen heating surfaces 28, 29.

After a first superheating in the platen heating surfaces 28, 29, the vapor is further heated in the superheater 30. After cooling in the region of the connecting conduit 69, final superheating takes place in the final superheater 31. The live vapor then flows to the consumer circuit at the final temperature determined by the injection control systems 75 to 77.

In order to ensure that all the combustion chamber walls 5 to 8 and 14 are always reliably cooled, the amount of feedwater is not reduced during operation to below a certain critical load. This critical load is preferably between 20% and 40% of the full load. Consequently, the relative porportions of water and vapor leaving the vapor separator 40 fluctuate in a very considerable range. On starting up, no vapor is initially produced and the ratio of the mass flow of water to vapor is then infinite. When the load exceeds the critical load, the ratio of the mass flow of water to vapor is about 3. In order that the working medium (which is initially in the liquid state) can be driven through the enclosing walls and the water separator 52 at low loads, a specific pressure drop must be built up at the adjusting valve 44, for which purpose the valve 44 is actuated manually or automatically according to the load.

A special advantage of the circuit is that the relatively short tubes 13 of the partition 14 always carry a considerable proportion of water right up to their ends, so that superheating is reliably prevented in any of these tubes 13. Since the tubes 10 of the enclosing walls extend in a plurality of walls because of their inclined arrangement, uniform heating of the tubes is ensured. Thus, if the distribution is properly adjusted, there are no appreciable differences in the final enthalpy values. Of course, it is possible for a slight super-heating to occur in one or other of the tubes 10 but this is less dangerous than in the case of the partition 14, because the enclosing walls 5–8 are substantially protected from the gas radiation in the top zone. Thus, there is no risk of high tube over-temperatures in any case.

Referring to FIG. 2, in which like reference characters indicate like parts as above, the vapor generator may have a circulating pump 80 provided between the economizer 33 and the partition 14. In this case, the water separated in the separator 52 is recycled upstream of the circulating pump 80. On the input side, the branch conduit 48 is connected between the circulating pump 80 and the partition 14. The control valve 49 is influenced by a controller 85 which receives an actual-value from a temperature measuring element or transmitter 86 in the conduit 42, and a set-value via a signal line 88 from a second temperature transmitter 89 disposed on the vapor separator 40.

The water from the vapor separator 40 is cooled by means of the control system 49, 85 to 89 by the fact that the temperature upstream of the throttle valve 43 is lower than the temperature at the vapor separator 40 as determined by the temperature transmitter 89, the difference between the two temperatures being a specific value which can be set at the controller 85.

In this exemplified embodiment, the circulating pump 80 is driven, preferably up to about 50% load. Above this load, the pump can run freely or be shut off when disposed in a bypass to the main flow of working medium. A considerable water surplus is therefore circulated through the partition 14, vapor separator 40, the enclosing walls 5–8 and the water separator 52 at a load less than 50% of the normal load.

The adjusting valve 44 is influenced, for example, by one of the control circuits shown in FIGS. 3*a* to 3*e*.

Figure 3:
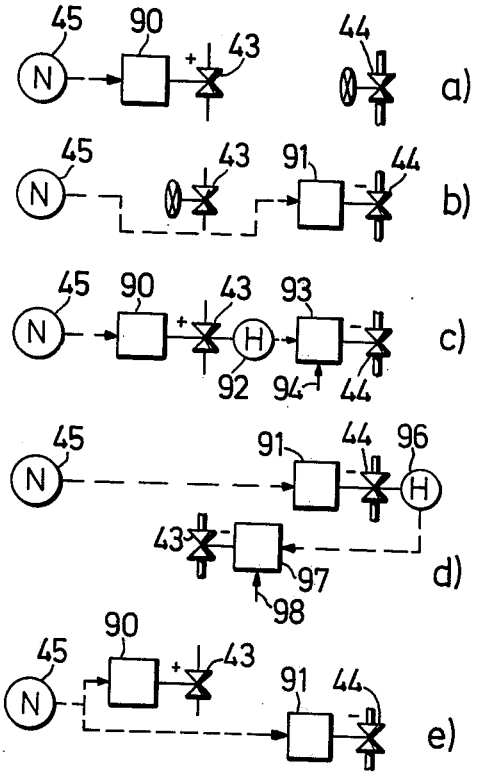

According to the circuit shown in FIG. 3*a*, the level transmitter 45 acts, as in FIG. 1, on the throttle valve 43 via a controller 90 which may, for example, be a PID controller, so that the throttle valve 43 is opened as the level rises. The adjusting valve 44 is adjusted manually or by a load-dependent control system in this case.

According to FIG. 3*b*, the level transmitter 45 influences the adjusting valve 44 via a controller 91 which so operates, in contrast to the controller 90, that the adjusting valve 44 is actuated to close as the level rises. It may be advantageous for the throttle valve 43 to be adjusted according to the load either manually or automatically in these conditions so that the adjusting valve 44 is always opened as wide as possible.

According to the control circuit shown in FIG. 3*c*, the throttle valve 43 is influenced by the level transmitter 45 and its position is measured by a transmitter 92. The signal of the transmitter 92 is then fed as an actual-value to a controller 93 which receives a set-value for the movement of the throttle valve 43 via a line 94. The output of the controller 93 acts on the adjusting valve 44. This cascade circuit gives a very low pressure loss.

The cascade circuit shown in FIG. 3*d* operates similarly to FIG. 3*c*. That is, by way of a controller 91, the level transmitter 45 influences the adjusting valve 44, on which a position transmitter 96 is disposed. The transmitter 96 influences the throttle valve 43 via a controller 97 to which a set-value is fed via a line 98 for the position of the adjusting valve 44. This circuit also automatically gives a very low pressure drop.

The circuit shown in FIG. 3*e* is a combination of the circuits according to FIGS. 3*a* and 3*b*. The signal from the level transmitter 45 is fed simultaneously to the two controllers 90, 91, which move the throttle valve 43 and the adjusting valve 44 in different directions of operation. Of course, these circuits can be varied in different ways. For example, in the embodiment shown in FIG. 3*e*, the two valves 43, 44 may operate in a staggered relationship instead of simultaneously.

The circuits illustrated are also suitable for sliding pressure operation, even if supercritical pressure is reached at high loads. Of course, these conditions require corresponding actuation of the valves. In such cases, the partition and the enclosing walls are preferably arranged in an exclusively series circuit.

What is claimed is:

1. A vapor generator comprising a plurality of interconnected tubes defining four enclosing walls and a partition for conveying a working medium threthrough in series from said partition to said walls, said partition being disposed within said enclosing walls to form two combustion chambers and having an outlet for the working medium;

a superheater disposed within said walls and having an inlet; and a vapor separator connected to said outlet of said partition to receive working medium therefrom, said separator having a water outlet connected to an inlet of said walls to deliver working medium thereto and a vapor outlet connected to said inlet of said superheater to deliver vapor thereto.

2. A vapor generator as set forth in claim 1 which further comprises a water separator having an inlet connected to an outlet of said walls and a vapor outlet connected to said inlet of said superheater to deliver vapor thereto.

3. A vapor generator as set forth in claim 2 which further comprises an economizer for the working medium connected to said partition on an upstream side relative to the flow of working medium and a circulating pump between said economizer and said partition to pump the working medium therebetween, said water separator having a water outlet connected to an inlet of said pump.

4. A vapor generator as set forth in claim 1 which further comprises a connecting line between said water outlet of said vapor separator and said inlet of said walls, a throttle valve in said connecting line for controlling the flow of working medium therethrough and means for controlling said valve in dependence upon the level of water in said vapor separator.

5. A vapor generator as set forth in claim 4 which further comprises a second connecting line between said vapor outlet of said vapor separator and said inlet of said superheater, a second throttle valve in said second connecting line for controlling the flow of working medium therethrough and means for controlling said second valve in dependence upon the level of water in said vapor separator.

6. A vapor generator as set forth in claim 4 which further comprises a branch conduit in parallel with said partition relative to the flow of working medium, said conduit being connected to said connecting line between said vapor separator and said walls upstream of said throttle valve relative to the flow of working medium in said connecting line.

7. A vapor generator as set forth in claim 6 which further comprises a control valve in said branch conduit and a temperature measuring element in said connecting line between a connection point of said branch conduit to said connecting line and said walls for measuring the temperature of the working medium flowing therethrough; said element being connected to said control valve to control said valve in response to the temperature measured in said element.

* * * * *

UNITED STATES PATENT AND TRADEMARK OFFICE

CERTIFICATE OF CORRECTION

PATENT NO. : 4,325,328

DATED : April 20, 1982

INVENTOR(S) : Pawel Miszak

It is certified that error appears in the above—identified patent and that said Letters Patent is hereby corrected as shown below:

Column 4, line 55 change "a" to --the--.

Signed and Sealed this

*Twenty-seventh* Day of *July 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,325,328

DATED : April 20, 1982

INVENTOR(S) : Pawel Miszak

It is certified that error appears in the above—identified patent and that said Letters Patent is hereby corrected as shown below:

Cover page, item 73, after "Sulzer Brothers Limited, Winterthur, Switzerland" insert --Mitsubishi Heavy Industries, Ltd., Tokyo, Japan--

Signed and Sealed this

*Sixth* Day of *September 1983*

[SEAL]

*Attest:*

GERALD J. MOSSINGHOFF

*Attesting Officer*

*Commissioner of Patents and Trademarks*